United States Patent [19]

Grimes et al.

[11] 3,938,152

[45] Feb. 10, 1976

[54] MAGNETIC ABSORBERS

[75] Inventors: Dale M. Grimes; William W. Raymond; Ralph J. Hach; Rodger M. Walser, all of Ann Arbor, Mich.

[73] Assignee: McDonnell Douglas Corporation, St. Louis, Mo.

[22] Filed: June 3, 1963

[21] Appl. No.: 285,128

[52] U.S. Cl. ..... 343/18 A

[51] Int. Cl.[2] ..... H01Q 17/00

[58] Field of Search ..... 343/18 A, 18; 252/62.5

[56] References Cited

UNITED STATES PATENTS

| | | | |
|---|---|---|---|
| 2,762,778 | 9/1956 | Gorter | 252/62.5 |
| 2,996,710 | 8/1961 | Pratt | 343/18 |
| 3,191,132 | 6/1965 | Mayer | 333/79 |

OTHER PUBLICATIONS

Smoek, J. L., New Material In Ferromagnetic Materials, Elsevier Publishing Co., Inc. Amsterdam (1947), pp. 71–98.

Brailsford, F., Magnetic Materials, Mathuem & Co. Ltd. (1960), pp. 171–172.

*Primary Examiner*—Malcolm F. Hubler

*Attorney, Agent, or Firm*—Barnes, Kisselle, Raisch & Choate

EXEMPLARY CLAIM

1. In an absorber for minimizing reflections of electromagnetic radiation of preselected radar wave lengths in the approximate corresponding preselected frequency range of 10 megacycles to 15,000 megacycles wherein a layer of absorber material has a highly conductive planar backing with the absorber material and the backing arranged and disposed so as to establish a standing wave with a maximum magnetic field positioned within said layer in response to radiation incident upon said layer, that improvement wherein said absorber is free of static, externally-applied magnetic fields, said absorber material comprises a ferrimagnetic metallic oxide having a complex permeability the imaginary part of which is substantially greater than the real part of said permeability at frequencies within said preselected range, said material has a complex permittivity, a complex permeability and a layer thickness $\tau$ such that the product of $B\tau$ is substantially less than unity where B is the wave number of radiation within said range measured inside the absorber material and said thickness of said layer is substantially less than one quarter of a wave length measured inside said material at preselected frequencies within said range so that absorption is substantially independent of said permittivity of said material at said preselected frequencies within said range.

7 Claims, 3 Drawing Figures

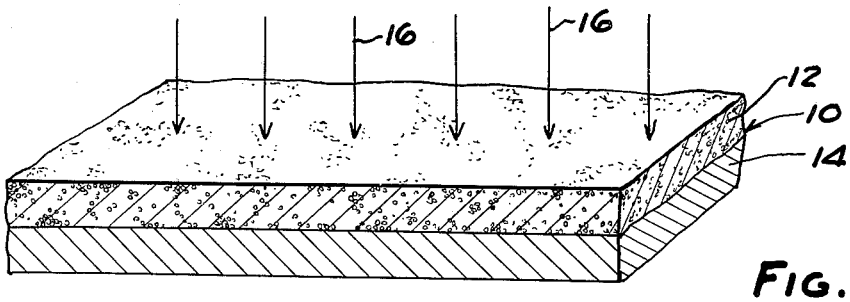
FIG. 1
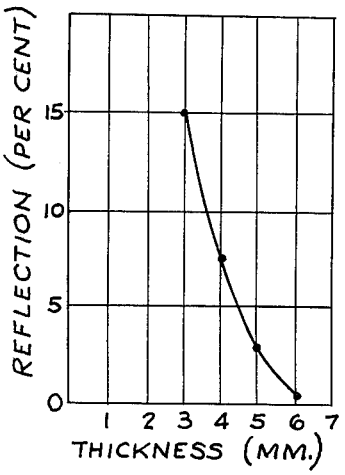
FIG. 2
FIG. 3
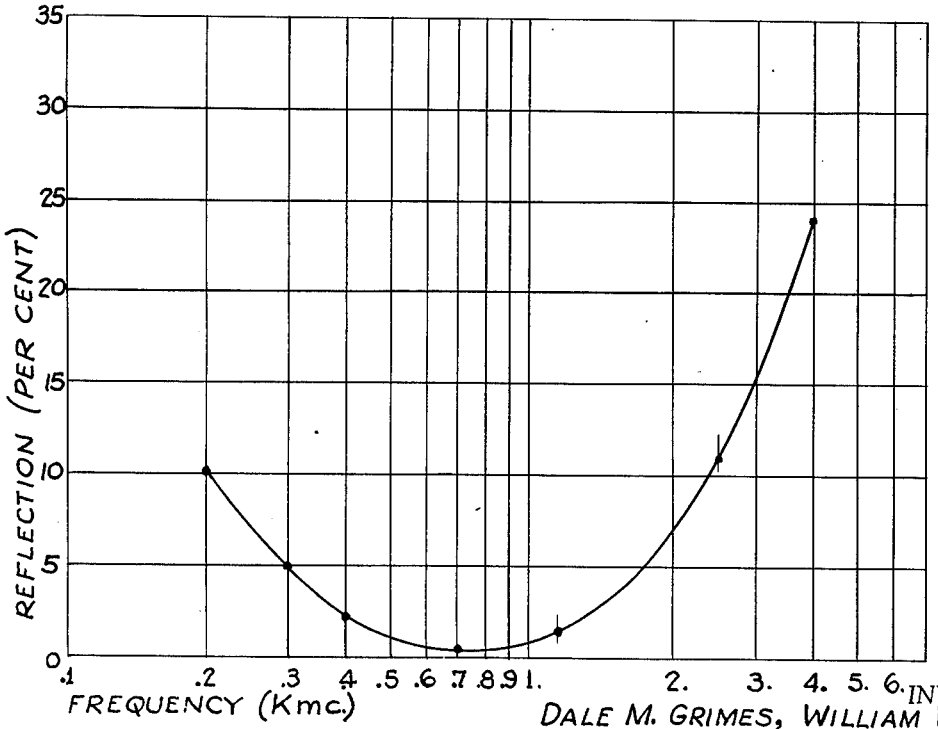
INVENTORS
DALE M. GRIMES, WILLIAM W. RAYMOND,
RALPH J. HACH & RODGER M. WALSER
BY
Barnes, Kisselle, Raisch & Choate
ATTORNEYS

MAGNETIC ABSORBERS

This invention relates to electromagnetic radiation absorbers and in particular to a magnetic absorber for minimizing reflections over a frequency band within the range of approximately 10 megacycles to 15,000 megacycles.

Numerous applications require eliminating electromagnetic radiation reflections, as for example, eliminating antenna ghosts caused by the antenna ground plane, or other obstructions such as masts on ships, eliminating reflections in "dead" chambers which are used for testing, and eliminating radar reflections for preventing or minimizing detection.

Prior art attempts to eliminate reflections include the Salisbury screen method, the resonant method and the nonresonant method. In the Salisbury screen method, a screen having carefully selected resistance characteristics is positioned at the location of maximum electric field which occurs at a quarter wave length from the surface to be protected. The Salisbury screen method has little practical usefulness because the absorber is quite thick and it is effective for only narrow frequency ranges and incident angle variations. In the prior art nonresonant methods the incoming radiation penetrates a dielectric layer and is reflected by a conducting surface. The layers are made quite thick so that in the course of being reflected the wave is substantially attenuated before it re-emerges from the layer. Because the layer must be made of a material having small high frequency losses and small reflection properties to assure penetration and reflection, the layer must also be very thick to effectively attenuate the wave. In prior art resonant methods high loss dielectric materials are positioned directly adjacent the conducting surface which is to be protected. The dielectric material has an effective thickness measured inside the material nearly equal to odd multiples of one quarter of the wave length of the incident radiation. This method has limited usefulness since the resonant thickness is large and bandwidth is very narrow at lower frequencies. Prior art attempts to overcome these deficiencies include dispersing electrically conducting ferromagnetic particles in the dielectric. However, when metallic particles are dispersed in the dielectric, high initial permeabilities, for example in the range of 10 to 100, cannot be achieved together with a low conductivity, as for example within the range of about $10^{-2}$ to $10^{-8}$ mhos per meter.

The objects of this invention are to provide absorber materials that can be used effectively in thin layers to overcome the disadvantages incurred with thick layers required by prior art absorber techniques; that are effective absorbers within frequency bands lying in the frequency range of approximately 10 megacycles to 15,000 megacycles; that for the low frequencies have high initial permeability and low conductivity as compared to prior art absorber materials; that are effective absorbers for wide ranges of incident angles; that function substantially independent of the permittivity of the absorber material at low frequencies; that are mechanically strong; that can be used in high temperature environments; and that dissipate more energy than prior art absorber materials.

This invention contemplates eliminating reflections by positioning a layer of insulating or semiconducting ferrite, and in particular a ferrimagnetic metallic oxide, directly adjacent a conducting surface so that radiation reflected from the conductor varies the boundary conditions at the front face of the ferrite in such a way that substantially all the incident energy penetrates the ferrite and is dissipated therein. The term ferrite as used in this application refers to the ferrimagnetic metallic oxides including but not limited to spinel, garnet, magnetoplumbite, and perovskite type compounds. According to this invention, at low frequencies, frequencies generally within the UHF to L band range, energy is extracted predominantly from the magnetic field of the incident radiation while at high frequencies, frequencies generally in the L band and higher, energy is extracted more equally from the magnetic and electric fields.

In general the absorber of this invention eliminates reflections because the incident radiation establishes a maximum magnetic field just at the surface of the conductor. It is therefore necessary that the incident radiation penetrate the ferrite so that the conductor will be effective to establish boundary conditions that position the maximum magnetic field within the ferrite. It has been found that the complex permeability of certain ferrimagnetic metallic oxides varies with frequency in such a way as to provide low reflection over wide frequency ranges without using large thicknesses of absorber material required by prior art techniques.

In the drawings:

FIG. 1 is a fragmentary sectional view of an absorber comprising a thin ferrite layer secured directly to a metal backing.

FIG. 2 illustrates variations in the per cent reflection for various layer thicknesses of one of the mixed-crystal cubic ferrites of Example I.

FIG. 3 is a semi-logarithmic graph illustrating measured variations of per cent reflection over one frequency range for one of the mixed-crystal cubic ferrites of Example I.

FIG. 1 shows an absorber 10 comprising a layer 12 composed of a sintered ferrimagnetic metallic oxide which is attached directly to a highly reflective metal backing 14. Absorber 10 is adapted to eliminate reflection of electromagnetic energy generally indicated at 16. If reflections are to be eliminated from a highly conductive metal object, the object may form backing 14.

Considering a plane conducting surface covered by a layer composed of a ferrimagnetic metallic oxide, for normal incidence the fraction of the power reflection, R, is defined by the relationship:

$$R = \rho\,\rho^*$$

where $\rho$ = the reflection coefficient $$= \frac{j\eta \tan B\tau - 1}{j\eta \tan B\tau + 1}$$

$\eta$ = the characteristic wave impedance = $\sqrt{\mu/\epsilon}$

B = the wave number measured in the ferrite = $B_o\sqrt{\mu\epsilon}$ $B_o$ = the wave number in free space $\tau$ = the thickness of the ferrite layer $\epsilon$ = the relative permittivity of the ferrite $\mu$ = the relative permeability of the ferrite $\rho^*$ = the complex conjugate of $\rho$ At most frequencies the permeability and permittivity, $\mu$ and $\epsilon$, of ferrimagnetic metallic oxides must be treated as complex so that $\mu = \mu' - j\,\mu''$ and $\epsilon = \epsilon' - j\,\epsilon''$, where $\epsilon'$ and $\mu'$ are real and $\epsilon''$ and $\mu''$ are imaginary. From the above relationships it can be shown that when the layer is thin in the sense that $\eta \tan B\tau = \mu\tau B_0$, i.e., $B\tau$ is much less than unity, the power reflection coefficient R is:

$$R = \frac{B_0^2\tau^2(\mu'^2 + \mu''^2) + 1 - 2\,B_0\tau\mu''}{B_0^2\tau^2(\mu'^2 + \mu''^2) + 1 + 2\,B_0\tau\mu''}$$

The above relationship shows that for the thin layer situation the reflected wave can be made small independently of the permittivity of the magnetic material. Low minimum reflection will occur at a given frequency if $\mu''$ is substantially greater than $\mu'$ for the situation where $B\tau$ is much less than unity.

It can also be shown that where the electric field component is normal to the conductor, as the wave moves along in the magnetic material, it will be attenuated at a rate substantially independent of the permittivity of the magnetic material so long as (1) the magnitude of the complex permittivity $\epsilon$ is substantially greater than the imaginary part $\epsilon''$ of the complex permittivity or in the case of most ferrimagnetic metallic oxides where the complex permittivity $\epsilon$ is at least 5 and (2) the imaginary part $\mu''$ of the complex permeability is greater than zero. With high frequencies, above the L band, the permittivity $\epsilon$ of ferrimagnetic metallic oxides is real and essentially constant. It can also be shown that in thin layers the power reflection coefficient R is nearly independent of variations in permittivity for incident angles between the normal and parallel electric field situations and for polarizations where the electric field is either in the plane of incidence or perpendicular to the plane of incidence.

If the permeability $\mu$ and in particular the imaginary part $\mu''$ of the complex permeability vary as a function of $1/f$, the reflection coefficient $\rho$ is independent of frequency. In the UHF frequency range the permeability of certain ferrimagnetic metallic oxides approaches the $1/f$ variation. In the L band and higher frequencies the imaginary part $\mu''$ of the complex permeability is substantially greater than the real part $\mu'$; the variation in $\mu''$ is substantially proportional to $1/f^2$; and as previously noted the permittivity $\epsilon$ is real and constant. By using a ferrimagnetic metallic oxide having a permeability which varies substantially as a function of $f^{-n}$, where $n$ is within the range of from 1 to 2 for a 13 db absorber (R = 0.05) bandwidths of 170 per cent can be obtained easily with thicknesses of 3 to 5 millimeters over frequency ranges below the S band. The per cent bandwidth, %BW, is defined by the relationship:

$$\%BW = 200\,\frac{f_2 - f_1}{f_2 + f_1}$$

Although ferrimagnetic metallic oxides have been disclosed as particularly useful in a low frequency absorber, they are also useful as resonant absorbers. At any frequency the reflection is theoretically zero when the factor $j\sqrt{\mu/\epsilon}\,\tan B_0\tau\sqrt{\mu\epsilon}$ is equal to unity (1) so that the general equation for the voltage reflection coefficient $\rho$ is equal to zero.

According to this invention it has been found that ferrimagnetic metallic oxides which are especially suited for use as magnetic absorbers include cubic spinels, some hexagonal magnetoplumbite structured materials, and intermediate compositions including the ferroxplanas. This invention also contemplates the potential usefulness of garnet structure compounds and the perovskites. The general chemical formula of the cubic spinel type ferrite is:

$$MeFe_2O_4$$

where Me is one of the divalent ions of the elements Mn, Co, Ni, Cu, Zn, Mg, and Cd. Mixed crystals of two or more of the divalent ions as well as combinations of other ions having an average valence of two such as ½ (Li + Fe) are also useful as magnetic absorbers. These materials are ceramics which have low electrical conductivity in the range of from $10^{-4}$ to $10^{-12}$ mhos per meter in most cases accompanied by initial permeabilities in the range of from 10 to 500. Ceramics are not subject to weathering damage and can withstand elevated temperatures. In general, the absorber material is prepared by grinding the base materials into a powder, mixing and compacting the powder and then sintering the compact to provide a porous slab that is chemically homogeneous.

The slabs may be secured to the conductor by any suitable adhesive, such as a silicone adhesive that will not materially affect the magnetic properties of the absorber. Alternatively, a powdered ferrimagnetic metallic oxide may be mixed with a suitable binder and sprayed directly on the conducting surface. Although spraying is useful in applying absorber material to a curved surface, this method requires a small particle size which generally requires a sprayed layer that is thicker than where the porous slabs are secured directly to the conductor.

EXAMPLE I

A mixture consisting of nickel oxide (NiO), zinc oxide (ZnO), ferric oxide, ($Fe_2O_3$) and tetrachloronaphthalene binder, 5 per cent by weight of the ferric oxide, was mixed in a muller for 1 hour. Trichloroethylene, 3 per cent by weight of ferric oxide, was added and the mixture was mulled for another hour. The resulting powder was then screened through a 20 mesh screen and compacted under 10,000 psi pressure into tablets 25 by 25 by 6.00 millimeters, each tablet weighing 11.79 grams. A small quantity of compacting lubricant was added prior to the compacting operation. The tetrachloronaphthalene binder was removed by preheating the tablets in an oven at 350°C. for 48 hours. The tablets were then sintered at 1260° C. in contact with air for 24 hours and then cooled to room temperature over a period of 24 hours. The tablets were then lapped to a thickness of 5.00 millimeters.

Absorbers of different compositions were manufactured by varying the ratio of nickel oxide and zinc oxide in accordance with the relationship $Ni_{(x)}Zn_{(1-x)}Fe_2O_4$ where $x$ is varied between 0.3 and 1.0. The composition, the frequency range over which the per cent power reflected R was less than or equal to 5 per cent, and the bandwidth corresponding to that frequency range are specified for some of the compositions in the following table.

TABLE 1

| Composition (X) | Frequency range at R ≦ 0.05 (Mc) | Bandwidth(%) |
|---|---|---|
| $Ni_{.35}Zn_{.65}Fe_2O_4$ | 55 – 1005 | 179 |
| $Ni_{.45}Zn_{.55}Fe_2O_4$ | 145 – 1040 | 151 |
| $Ni_{.65}Zn_{.35}Fe_2O_4$ | 530 – 2750 | 135 |

By way of further example, the general utility of a $Ni_{(x)}Zn_{(1-x)}Fe_2O_4$ composition is illustrated by the results set forth in the following tables for the composition $Ni_{0.45}Zn_{0.55}Fe_2O_4$produced by a process substantially similar to the process previously set forth.

The per cent reflection is measured for several thicknesses in the frequency range under consideration to ascertain an optimum thickness. Table 2 shows typical variations of per cent reflection for various thicknesses at a frequency of 700 megacycles. These variations are illustrated in FIG. 2.

TABLE 2

| Reflection (%) | Thickness (mm) |
|---|---|
| 16.0 | 3.0 |
| 7.5 | 4.0 |
| 3.0 | 5.0 |
| 0.4 | 6.0 |

Per cent reflection is then measured over the frequency range under consideration for samples having a thickness in the range corresponding to low per cent reflection, for example R equal to or less than 0.05. Table 3 shows the variations in per cent reflection for a sample 6 millimeters thick over a frequency range of 0.3 kilomegacycles to 6.0 kilomegacyles. These variations are illustrated in FIG. 3, frequency being plotted on a logarithmic scale.

TABLE 3

| Reflection (%) | Frequency (Kmc) |
|---|---|
| 10.0 | 0.2 |
| 5.0 | 0.3 |
| 2.2 | 0.4 |
| 0.4 | 0.7 |
| 1.4 | 1.3 |
| 11.0 | 2.5 |
| 24.0 | 4.0 |
| 34.0 | 6.0 |

Table 4 shows variations in permeability $\mu$ and permittivity $\epsilon$ with frequency above the resonant frequency for $\mu$. In the frequency range under consideration the imaginary permeability $\mu''$ is substantially greater than the real permeability $\mu'$ and the permittivity $\epsilon$ is substantially constant.

TABLE 4

| Frequency (Kmc) | Permeability | Permittivity |
|---|---|---|
| 0.2 | 13.0 – j 22.0 | 16.5 |
| 0.4 | 6.0 – j 14.7 | 11.0 |
| 0.7 | 2.2 – j 9.5 | 7.5 |
| 1.3 | 1.0 – j 5.7 | 8.0 |
| 2.5 | 0.5 – j 3.1 | 9.0 |
| 4.0 | 0.5 – j 1.8 | 9.0 |
| 6.0 | 0.6 – j 1.0 | 8.9 |

In general a decrease in the thickness of the layer is accompanied by an increased bandwidth, a higher minimum reflection, and a higher mid-frequency. In the composition of this example the nickel ion can be replaced by divalent ions of manganese, magnesium, copper or cobalt and zinc can be replaced by cadmium.

EXAMPLE II

Mixed-crystal ferrites having the general composition $CdFe_2O_4 + Li_{0.5}Fe_{2.5}O_4 + Fe_3O_4$ also provide useful absorbers. Extra iron is treated as $Fe_3O_4$ for clarity although in fact it is probably in the $\gamma$ $Fe_2O_3$ structure.

Reflections less than or equal to five per cent may be achieved with composition ranges of: $CdFe_2O_4$, 0 to 50 mol per cent; $Li_{.5}Fe_{2.5}O_4$, 40to 100 mol per cent; and $Fe_3O_4$, 0 to 20 mol per cent. Generally, the lithium ferrite and magnetite are interchangeable while the larger the cadmium ferrite content, the lower the frequency range.

Ferrites of this type may be prepared by pre-firing a mixture of CdO and $Fe_2O_3$ at 900° C. for one-half hour, pre-firing a mixture of $Li_2CO_3$ and $Fe_2O_3$ at 750° C. for one-half hour, and pre-firing the balance of $Fe_2O_3$ alone at 800° C. for one-half hour. Each ferrite is ground separately to pass a 20 mesh screen. The ferrites are then mixed without grinding and pressed with or without a binder into pellets which are then sintered at a temperature of 1150° to 1250° C. for at least two hours.

One particular mixed ferrite having the composition $0.45\ Li_{0.5}Fe_{2.5}O_4 + 0.30\ CdFe_2O_4 + 0.25\ Fe_3O_4$ yielded the following results.

Table 5 shows variations in the per cent reflection calculated from the relationship $R = \rho\rho^*$ using measured values of $\mu$ and $\epsilon$, and also shows the measured per cent reflection, both of which were ascertained over the frequency range under consideration for a layer of the ferrite $0.45\ Li_{.5}Fe_{2.5}O_4 + 0.30\ CdFe_2O_4 + 0.25\ Fe_3O_4$ 5 millimeters thick.

TABLE 5

| Frequency (Kmc.) | Calculated Reflection (%) | Measured Reflection (%) |
|---|---|---|
| 0.5 | 6.4 | 6.0 |
| 0.7 | 1.2 | 1.0 |
| 1.0 | 2.1 | 0.2 |
| 1.4 | 0.7 | 0.3 |
| 2.0 | 12.6 | 7.3 |
| 3.0 | 11.3 | 17 |
| 4.0 | 37.2 | 23 |

Table 6 shows variations in the per cent reflection for various layer thicknesses of the composition $0.45\ Li_{.5}Fe_{2.5}O_4 + 0.30\ CdFe_2O_4 + 0.25\ Fe_3O_4$ at a frequency of 1420 megacycles.

TABLE 6

| Thickness (mm.) | Reflection (%) |
|---|---|
| 1 | 45.3 |
| 2 | 18.4 |
| 3 | 5.5 |
| 4 | 0.7 |
| 5 | 0.7 |
| 6 | 3.1 |
| 7 | 6.4 |
| 8 | 9.3 |
| 9 | 11.2 |
| 10 | 12.2 |
| 12 | 12.0 |
| 14 | 10.9 |
| 20 | 9.7 |

With the ferrite giving the results shown in tables 5 and 6, the real part $\mu'$ of the permeability drops off from 10 to about −0.07 over the frequency range of interest; the imaginary part $\mu''$ of the permeability drops from 16 to about 0.3. The real permittivity $\epsilon'$ remains essentially constant at 10 while the imaginary permittivity $\epsilon''$ drops slowly from 2 to about 0.3. Generally, in the mixed ferrite of this example, cadmium may be replaced by zinc.

EXAMPLE III

Hexagonal structured ferrites are also useful absorbers. In general, the appropriate oxides or carbonates are mixed in an attritor in ethanol, dried, and then pressed into pellets. The ferrite is then pre-fired at about 1100° C. on platinum in an air atmosphere, crushed to pass through a 100 mesh screen, pressed at about 4000 psi and then sintered in air at a temperature of about 1250° C.

One particular hexagonal ferrite having the composition $Zn_2Ba_2Fe_{12}O_{22}$ yielded the following results.

Table 7 shows variations in the per cent reflection, calculated from measured values of $\mu$ and $\epsilon$, and also measured over the frequency range under consideration for a layer of the composition $Zn_2Ba_2Fe_{12}O_{22}$ 5 millimeters thick.

TABLE 7

| Frequency (Kmc.) | Calculated Reflection (%) | Measured Reflection (%) |
|---|---|---|
| 1.0 | 21.4 | 5.0 |
| 1.4 | 2.1 | 2.0 |
| 2.0 | 5.2 | 4.5 |
| 4.0 | 14.9 | 19.0 |

Table 8 shows variations in the per cent reflection for various layer thicknesses of the composition $Zn_2Ba_2Fe_{12}O_{22}$ at a frequency of 1420 megacycles.

TABLE 8

| Thickness (mm.) | Reflection (%) |
|---|---|
| 1 | 53.7 |
| 2 | 26.7 |
| 3 | 11.2 |
| 4 | 3.7 |
| 5 | 2.1 |
| 6 | 4.6 |
| 7 | 8.5 |
| 8 | 11.9 |
| 9 | 13.4 |
| 10 | 13.1 |
| 12 | 9.4 |
| 14 | 5.8 |
| 20 | 5.4 |

With the ferrite giving the results shown in tables 7 and 8, the real part $\mu'$ of the permeability drops off from 9 to 1 over the frequency range of interest; and the imaginary part $\mu''$of the permeability drops from 6 to 3. The real permittivity $\epsilon'$ drops from 46 to 20 while the imaginary permittivity $\epsilon''$ drops slowly from 9 to 7. In the above composition zinc can be completely or partially replaced by cobalt, magnesium, or nickel to produce a Y-structured cobalt, magnesium, or nickel compound.

Another hexagonal ferrite, a Z-structured ferroxplana having the composition $Co_2Ba_3Fe_{24}O_{41}$ yielded the following results.

Table 9 shows variations in the per cent reflection versus frequency for a layer of the composition $Co_2Ba_3Fe_{24}O_{41}$ 3.25 mm. thick.

TABLE 9

| Reflection (%) | Frequency (Kmc) |
|---|---|
| 40 | 1.6 |
| 14 | 1.5 |
| 7.0 | 2.0 |
| 7.0 | 3.0 |
| 9.5 | 4.0 |
| 12.5 | 5.0 |
| 12.0 | 6.0 |

TABLE 9-continued

| Reflection (%) | Frequency (Kmc) |
|---|---|
| 9.0 | 7.0 |
| 7.0 | 8.0 |
| 4.0 | 9.0 |
| 1.0 | 10.0 |

Table 10 shows variations in the per cent reflection for various layer thicknesses of the composition $Co_2Ba_3Fe_{24}O_{41}$ at a frequency of 2 Kmc.

TABLE 10

| Reflection (%) | Thickness (mm) |
|---|---|
| 12.5 | 2.75 |
| 9.0 | 3.00 |
| 7.0 | 3.25 |
| 4.0 | 3.52 |
| 2.0 | 3.75 |
| 2.0 | 4.00 |
| 0.5 | 4.50 |

Over the frequency range of 2.0 to 9.0 Kmc, the real permeability $\mu'$ drops to a minimum of 0.2 at 4.0 Kmc and levels off at about 0.5, the imaginary permeability $\mu''$ drops from 5 to 0.5, and the complex permittivity remains substantially constant. In the above composition cobalt can be partially replaced with zinc, copper, nickel, or magnesium.

We claim:

1. In an absorber for minimizing reflections of electromagnetic radiation of preselected radar wave lengths in the approximate corresponding preselected frequency range of 10 megacycles to 15,000 megacycles wherein a layer of absorber material has a highly conductive planar backing with the absorber material and the backing arranged and disposed so as to establish a standing wave with a maximum magnetic field positioned within said layer in response to radiation incident upon said layer, that improvement wherein said absorber is free of static, externally-applied magnetic fields, said absorber material comprises a ferrimagnetic metallic oxide having a complex permeability the imaginary part of which is substantially greater than the real part of said permeability at frequencies within said preselected range, said material has a complex permittivity, a complex permeability and a layer thickness $\tau$ such that the product of B $\tau$ is substantially less than unity where B is the wave number of radiation within said range measured inside the absorber material and said thickness of said layer is substantially less than one quarter of a wave length measured inside said material at preselected frequencies within said range so that absorption is substantially independent of said permittivity of said material at said preselected frequencies within said range.

2. The absorber set forth in claim 1 sherein B $\tau$ is substantially equal to or less than 0.1 radians so that tan B $\tau$ is approximately equal to B $\tau$ at said preselected frequencies.

3. The absorber set forth in claim 1 wherein said ferrimagnetic metallic oxide has an imaginary part of said permeability which varies substantially as a function of $f^{-n}$ where $f$ is a frequency variation within said preselected frequency range and $n$ is in the range of from 1 to 2.

4. The combination set forth in claim 1 wherein said layer is secured directly to said backing.

5. The combination set forth in claim 1 wherein said metallic oxide comprises a cubic ferrite having a formula $$MeFe_2O_4$$

where Me is one or more divalent ions selected from the group consisting nickel, manganese, magnesium, ½ (lithium + iron), copper, cobalt, cadmium and zinc.

6. The combination set forth in claim 1 wherein said metallic oxide comprises a mixed cubic ferrite having the formula $$Ni_{(x)}Zn_{(1-x)}Fe_2O_4$$

where $x$ is between 0.3 and 1.0.

7. The combination set forth in claim 1 wherein said metallic oxide comprises a hexagonal ferrite.

* * * * *